US005361517A

United States Patent [19]

Liener

[11] Patent Number: 5,361,517

[45] Date of Patent: Nov. 8, 1994

[54] HEEL PROTECTOR

[76] Inventor: Robert Liener, 6408 Windsong, Dallas, Tex. 75252

[21] Appl. No.: 74,982

[22] Filed: Jun. 10, 1993

Related U.S. Application Data

[63] Continuation of Ser. No. 819,842, Jan. 13, 1992, abandoned.

[51] Int. Cl.[5] ..... A43B 5/00

[52] U.S. Cl. ..... 36/72 R; 36/132; 36/72 B

[58] Field of Search ..... 36/72 R, 72 B, 7.5; 2/DIG. 6, 338; D2/271, 277, 627, 633, 636; 24/306, 442

[56] References Cited

U.S. PATENT DOCUMENTS

| | | | |
|---|---|---|---|
| D. 145,439 | 8/1946 | Gottschalk | D2/271 |
| D. 172,004 | 4/1954 | Carpenter | D2/627 |
| D. 281,739 | 12/1985 | Hazley | D2/264 |
| D. 286,460 | 11/1986 | Haber | D2/314 |
| D. 286,581 | 11/1986 | Panth | D2/636 |
| D. 288,382 | 2/1987 | Birchwood | D2/314 |
| D. 321,583 | 11/1991 | McCoy | D2/277 |
| 1,110,045 | 9/1914 | Dalton | 36/72 R |
| 2,061,160 | 11/1936 | Kendall | 36/72 R |
| 2,260,037 | 10/1941 | Lazarus | 36/7.5 |
| 2,292,770 | 8/1942 | Platkin | D2/277 |
| 2,878,482 | 3/1959 | Rebajes | 2/338 X |
| 3,187,446 | 6/1965 | Boldemann | 36/72 B |
| 3,983,641 | 10/1976 | Wright | 36/72 B |
| 4,553,293 | 11/1985 | Blum | 24/306 X |
| 4,577,418 | 3/1986 | Nagy | 36/72 B |
| 4,662,082 | 5/1987 | Shabazz | 36/72 B |
| 4,727,659 | 3/1988 | Walker | 36/72 B |
| 4,794,705 | 1/1989 | Sanders | 36/72 B |
| 4,825,563 | 5/1989 | Strongwater | 36/72 B X |
| 4,872,271 | 10/1989 | Allen | 36/72 B |
| 4,918,757 | 4/1990 | Janssen et al. | 2/DIG. 6 X |

FOREIGN PATENT DOCUMENTS

| | | | |
|---|---|---|---|
| 600978 | 2/1926 | France | 36/72 B |

OTHER PUBLICATIONS

Journal of the American Medical Association, vol. 168, No. 7, Oct. 19, 1958, "Self Adhering Nylon Tapes".

*Primary Examiner*—Jimmy G. Foster
*Assistant Examiner*—BethAnne C. Cicconi
*Attorney, Agent, or Firm*—Gregory W. Carr

[57] ABSTRACT

The invention is a footwear protector comprised of a single piece of material of uniform thickness and width which, when in place, forms an open-toed design protector. The protector utilizes an opening at one end to allow the insertion of any front tassel or decoration of the protected footwear and to secure the protector to the front portion of the footwear. Velcro® fasteners are located at each end of the protector's length to further secure the protector. This fastening system allows the protector to be fitted to different size footwear, and facilitates quick and easy attachment and removal of the device. Additionally, the protector is constructed of a soft, nonabrasive fabric, allowing the protector also to be used as a footwear buffing and cleaning cloth when not secured to footwear.

10 Claims, 1 Drawing Sheet

HEEL PROTECTOR

This application is a continuation of application Ser. No. 07/819,842, filed Jan. 13, 1992, now abandoned.

TECHNICAL FIELD

This invention relates generally to footwear protectors, and more specifically, is directed towards shoe and heel protectors which protect the surface of the shoe and heel during the operation of a vehicle.

BACKGROUND AND SUMMARY

Since the invention of the modern automobile, the driver has experienced the problem of worn or scuffed footwear from the necessary placement and use of the feet in connection with the operation of the automobile. The heel and back portion of the driver's footwear come in contact with the floorboard as the feet are maneuvered to depress and release the gas, brake and clutch pedals of the automobile. This contact and movement causes the footwear, especially the right one, to become scuffed or scarred in certain areas.

In response to this problem, many footwear protectors have been developed utilizing various shapes and designs. These protectors, however, have been found to provide only limited protection often at the expense of ease, comfort and safety. Many available designs also involve complicated construction from multiple pieces of material that must be separately cut and assembled in manufacture. These complex designs result in higher costs for manufacturers and consumers alike.

The present invention provides a solution to the aforementioned shortcomings of available footwear protectors. The invention is a single piece of material which wraps around the footwear to be protected, forming an open-toed design protector. An opening placed in the allows the front portion of the footwear to protrude through the material sheet, thus securing the protector to the footwear. Any tassel or other adornment located on the front of the footwear can also protrude out of the protector through this opening. This provides a tighter fit of the protector on the footwear and does not damage the adornment during use of the protector. The ends of the protector are provided with Velcro® fasteners which allow the protector to be fitted to a variety of footwear sizes. This form of fastening also facilitates quick and easy attachment and removal of the protector. When not attached to footwear, the soft, nonabrasive material of the protector can be grasped at its ends and utilized as a buffing and cleaning cloth for footwear.

It is therefore an object of this invention to provide comfortable, safe-fitting protection for the entire rear portion and sides of various footwear.

It is another object of the invention to provide such protection in a manner which is quick and simple to utilize.

It is a still further object of this invention to provide footwear protection in a manner which does not restrict the movement of the foot or in any other way impede the driver's ability to operate the various pedals of an automobile.

It is another object of the invention to provide footwear protection in a manner which allows the protector to be used on footwear of various designs and sizes.

It is an additional object of the invention to provide a footwear protection design which allows for cost reducing ease of manufacture.

It is yet another object of the invention to provide a protector constructed of material such that the protector can be utilized as a footwear buffing and cleaning cloth when not secured to footwear.

BRIEF DESCRIPTION OF THE DRAWINGS

A more complete understanding of the invention may be had by reference to the following Detailed Description when taken in conjunction with the accompanying Drawing in which.

DETAILED DESCRIPTION

Figure 1:
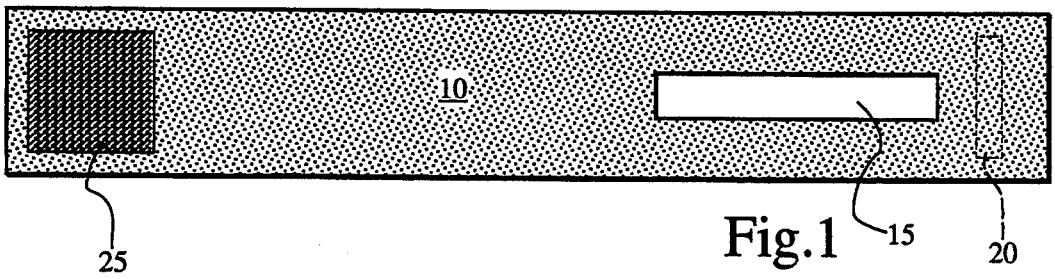
FIG. 1 is a side view of the protector, in a flat, open position.

Referring to FIG. 1 of the Drawing, the heel protector 10 comprises a one-piece rectangular length of material of substantially uniform thickness and width which can be wrapped around the heel portion of the footwear and secured along the side portion of the footwear. Although the protector 10 shown is cut from double-napped flannel, a resilient and durable fabric, it will be appreciated that other suitable materials and fashioning methods may be used, if desired.

Towards one end of its length, the footwear protector 10 includes a horizontally aligned, rectangular opening 15. The frontal portion of the footwear is inserted through the opening 15 to secure the heel protector 10 to the footwear 30. This opening 15 also allows for adornments of any kind located on the upper frontal portion of the footwear to protrude from the protector. A strip of Velcro® (loops) fastener 20 and a larger square of Velcro®(hooks) fastener 25 located at the opposite ends of the heel protector 10 provide the fastening means for further securing the protector. Although the fastening means is shown as Velcro® fasteners, it will be readily apparent that other suitable means of fastening could be used, if desired.

Figure 2:
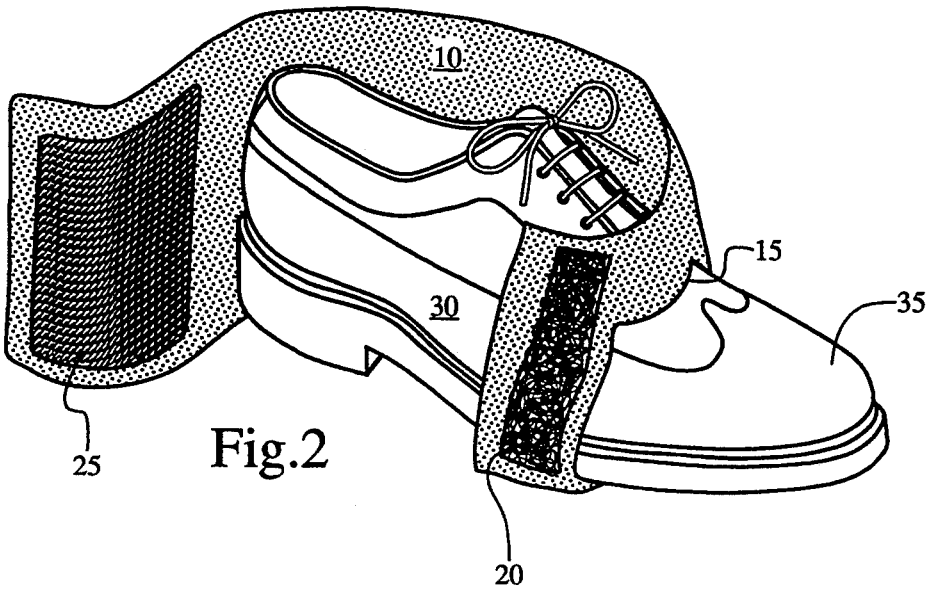
FIG. 2 is a perspective view of the protector demonstrating placement of the protector around footwear.

FIG. 2 illustrates placement of the heel protector 10 on the footwear 30. The toe portion 35 of the footwear is inserted through the rectangular opening 15 and the length of the heel protector 10 is wrapped around the footwear 30, using the Velcro® strip 20 and Velcro® square 25 to further secure the heel protector 10 on the footwear 30. The placement of the Velcro® strip 20 and Velcro® square 25 allows for the heel protector 10 to be easily secured to a variety of footwear sizes and designs.

Figure 3:
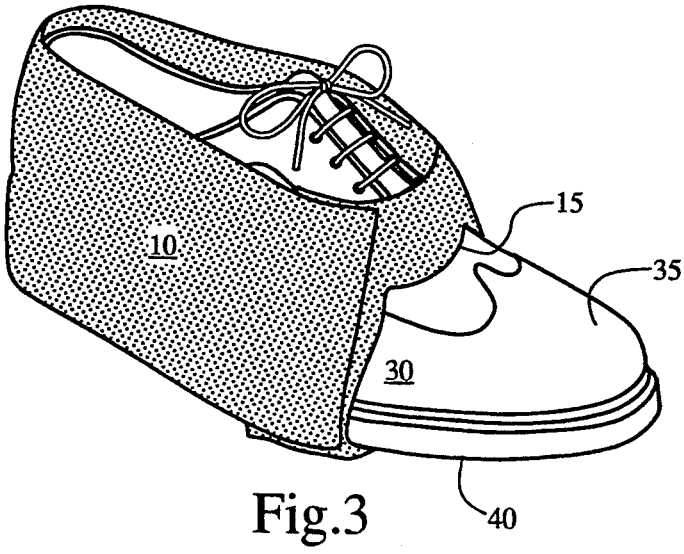
FIG. 3 is a perspective view of the protector fully secured around footwear.

As best shown in FIG. 3, the heel protector 10, when fully secured on the footwear 30, provides complete protection of the footwear 30. The sides, back, and heel of the footwear are protected from damage when the heel protector 10 is fully secured around the footwear 30. Moreover, the toe portion 35, any adornment, and the bottom 40 of the footwear 30 are not covered by the heel protector 10, so as to ensure a proper and snug fit while allowing safe and easy operation of an automobile.

When the heel protector 10 is not secured to the footwear 30, the heel protector 10 can be utilized as a footwear buffing and cleaning cloth. The soft, nonabrasive material sheet comprising the heel protector 10 can be grasped at its ends and used to buff and clean footwear.

Only the preferred embodiments of the invention have been described. It should be understood that the invention is not limited to the embodiments disclosed, but is intended to embrace any alternative, modifications, rearrangements, or substitutes of parts or elements as fall within the spirit and scope of the invention.

I claim:

1. A combination for protecting footwear surfaces comprising:

footwear including a toe portion at one end and a heel portion at the opposite end thereof, with opposed side portions extending therebetween;

a single sheet of material having first and second ends;

said sheet being removably wrapped around said footwear and including an unobstructed opening positioned in the first end, the opening sized for allowing only the toe portion of the footwear to extend therethrough, leaving the second end of the sheet for wrapping around the heel and side portions of the footwear; and attachment means for securing the second end of the sheet wrapped around the heel and side portions of the footwear to the first end of the sheet through which the toe portion of the footwear extends such that material sheet covers and protects the surfaces of the side and heel portions of the footwear.

2. The combination of claim 1 wherein the attachment means for the material sheet includes hook and loop fastening means located on each end of the sheet which, when the material sheet is wrapped around the footwear, engage each other and further secure the material sheet to the footwear.

3. The combination protector of claim 1 wherein the material sheet is of substantially uniform thickness and width throughout its length.

4. The combination of claim 1 wherein the material sheet is comprised of soft, nonabrasive fabric such that the material sheet can also be used as a buff cloth for footwear.

5. A combination for protecting footwear surfaces comprising:

footwear including a toe portion at one end and a heel portion at the opposite end thereof, with opposed side portions extending therebetween;

a single sheet of material having first and second ends;

said sheet being removably wrapped around said footwear and including an unobstructed opening positioned in the first end, the opening sized for allowing only the toe portion of the footwear to extend therethrough, leaving the second end of the sheet for wrapping around the heel and side portions of the footwear; and attachment means for securing the second end of the sheet wrapped around the heel and side portions of the footwear to the first end of the sheet through which the toe portion of the footwear extends such that material sheet covers and protects the surfaces of the side and heel portions of the footwear;

said material sheet comprised of soft, nonabrasive fabric such that the sheet can also be used as a buff cloth for footwear.

6. The combination of claim 5 wherein the attachment means for the material sheet includes hook and loop fastening means located on each end of the sheet which, when the material sheet is wrapped around the footwear, engage each other and secure the material sheet to the footwear.

7. A combination of claim 5 wherein the material sheet is of substantially uniform width and thickness throughout its length.

8. A combination for protecting footwear surfaces, comprising:

footwear, including a toe portion at one end and a heel portion at the opposite end thereof, with opposed side portions extending therebetween;

a single sheet of material of substantially uniform thickness and width having first and second ends wrapped around the footwear;

said sheet including a single unobstructed opening positioned in the first end, the opening sized for allowing only the toe portion of the footwear to extend therethrough, leaving the second end of the sheet for wrapping around the heel and side portions of the footwear; and hook and loop fastening means located on each end of the sheet which, when the material sheet is wrapped around the footwear, engage each other and secure the second end of the sheet wrapped around the heel and side portions of the footwear to the first end of the sheet through which the toe portion of the footwear extends such that material sheet covers and protects the surfaces of the side and heel portions of the footwear.

9. A method for protecting footwear surfaces, the footwear including a toe portion at one end and a heel portion at the opposite end thereof, with opposed side portions extending therebetween, the method comprising the steps of:

wrapping around the footwear a single sheet of material having first and second ends; said step of wrapping including the step of extending the toe of the footwear through an unobstructed opening positioned in the first end, the opening sized for allowing only the toe portion of the footwear to extend therethrough, leaving the second end of the sheet for wrapping around the heel and side portions of the footwear; and attaching the second end of the sheet wrapped around the heel and side portions of the footwear to the first end of the sheet through which the toe portion of the footwear extends such that material sheet covers and protects the surfaces of the side and heel portions of the footwear.

10. The method of claim 9 wherein the sheet includes hook and loop fastening means located on each end of the sheet which, when the material sheet is wrapped around the footwear, engage each other and further secure the material sheet to the footwear.

* * * * *